US005941099A

United States Patent [19]

Kawase

[11] Patent Number: 5,941,099

[45] Date of Patent: Aug. 24, 1999

[54] SPLIT LATCH NEEDLE

[75] Inventor: Yuji Kawase, Wakayama, Japan

[73] Assignee: Precision Fukuhara Works, Ltd., Kyogo, Japan

[21] Appl. No.: 09/168,831

[22] Filed: Oct. 8, 1998

[51] Int. Cl.[6] ..... D04B 35/02

[52] U.S. Cl. ..... 66/123; 66/116

[58] Field of Search ..... 66/116, 119, 120, 66/121, 122, 123, 124, 57, 8, 64, 7

[56] References Cited

U.S. PATENT DOCUMENTS

| | | | |
|---|---|---|---|
| 2,431,635 | 11/1947 | Currier . | |
| 3,411,327 | 11/1968 | Beckenstein . | |
| 5,255,537 | 10/1993 | Schimko | 66/123 |
| 5,775,135 | 7/1998 | Shibata et al. | 66/219 |
| 5,806,347 | 9/1998 | Ando | 66/116 |

FOREIGN PATENT DOCUMENTS

| | | | |
|---|---|---|---|
| 55-180788 | 12/1980 | Japan . | |
| 56-78896 | 6/1981 | Japan . | |
| 2169008 | 7/1986 | United Kingdom | 66/57 |

*Primary Examiner*—John J. Calvert
*Assistant Examiner*—Larry D. Worrell, Jr.
*Attorney, Agent, or Firm*—Alston & Bird LLP

[57] ABSTRACT

A latch needle is provided and includes a working needle having a needle head with a hook and a latch and a body portion having a connecting projection extending outwardly therefrom, and a butt needle having a connecting indentation therein which receives the connecting projection to connect the working needle and butt needle together and a butt thereon between the needle head of the working needle and the connecting projection and the connecting indentations. The latch needle also includes reinforcement of the connection between the working needle and the butt needle in the form of a fastening projection and a fastening indentation located between the needle head and the butt on the butt needle.

9 Claims, 3 Drawing Sheets

SPLIT LATCH NEEDLE

FIELD OF THE INVENTION

The present invention relates to a latch needle for a knitting machine, in particular for a circular knitting machine. More specifically, the present invention relates to a latch needle for high speed circular knitting machines.

BACKGROUND OF THE INVENTION

Latch needles are mounted in a circular knitting machine in such a way that their backs are in contact with the needle bed in the needle grooves in the cylinder. As the cylinder rotates, the latch needles rotate at a high speed, while at the same time fixed cams established opposingly to the needle bed act on the butts of the latch needles, reciprocating the latch needles at a high speed. As the knitting speed increases, the force with which each cam acts on these needle butts also increases and is transmitted to the needle head as a shock wave, causing broken needle heads.

In an attempt to solve this problem, it has been proposed to incorporate into the needles means to absorb the shock wave that is generated and transmitted to the needle head when the cam acts on the butt. This proposal includes providing the needle trunk, which is between the butt and the needle head, with cutouts on the upper and lower sides. It has also been postulated that the thinner the needle shaft and the bridge that are left after the cutouts have been made the more effective the shock absorbing performance. This is a so-called meander-type latch needle, which is widely used today. Various and sundry other attempts at latch needles with shock absorbing capabilities have also been proposed.

In these so-called meander-type latch needles, depending on the structure of the knitting machine (for example a double knit machine employing a dial needle or a needle that is controlled by a special needle-selecting structure), there is a limit to how far the butt and the needle head can be distanced from each other, making it impossible to provide the needle trunk between the butt and the needle head with a shape that effectively absorbs the shock wave.

Another type of latch needle has been proposed based on the concept of completely blocking the shock wave, which is generated when the cam hits the butt, before it reaches the needle head. According to this concept, the shock wave is blocked by splitting the head part and the butt part, which were conventionally one unit. For example, Japanese Utility Model Application No. A-55-180788, Japanese Utility Model Application No. A-56-78896, and U.S. Pat. Nos. 2,431,635 and 3,411,327 propose this type of latch needle in one form or another. According to these utility models and patents, the working needle and the butt needle engage at the position of the butt of the butt needle or at a position closer to the front of the butt needle.

As for the latter type, i.e., the split-type latch needle, the variations disclosed in the patents and utility models mentioned above are rarely used in practice now. The reason is believed to be that none of them have produced satisfactory results.

SUMMARY OF THE INVENTION

With the foregoing in mind, it is an object of the present invention to provide a latch needle which obviates the deficiencies and disadvantages with prior proposed shock absorbing needles. The present invention accomplishes this object by providing a latch needle split into a working needle and a butt needle and by determining, after a number of experiments, that the position at which the working needle and the butt needle engage plays an important role in the effectiveness of shock absorption.

Accordingly, a latch needle of the present invention is characterized in that it is split into a working needle having a needle head with a hook and a latch and a body portion with at least one connecting projection, and a butt needle having a body portion including at least one connecting indentation into which the connecting projection is inserted, and a butt between the hook of the working needle and the connecting projection on the working needle and the connecting indentation of the butt needle. The overall length of the working needle may vary from the first one third to roughly the entire length of the latch needle.

The butt needle of the present invention has at least one indentation into which the connecting projection is inserted and at least one butt that goes into the cam groove of the knitting machine. In practice, many latch needles have a plurality of butts that go into cam grooves of the knitting machine.

From the viewpoint of machinability, it is preferable that the connecting projection has a rectangular shape and the indentation has a shape that complements the rectangle. However, as long as they can be connected as intended, any other shape can be adopted. For example, combinations of a semicircular projection and a semicircular indentation, a triangular projection and a triangular indentation, an W-shaped curved projection and its complementary curved indentation, etc., may be employed.

It is important that the connecting projection and indentation are engaged at a position farther than the position of the butt of the butt needle from the hook of the working needle. This is one feature that differentiates the present invention from prior split-type needles cited above. In other words, the hook of the working needle, the butt of the butt needle and the connecting projection and indentation must be disposed in that order. When a plurality of butts are established, the "butt of the butt needle" refers to "the control butt that is controlled by the lowering cam in an open-type cam". The present invention is not intended to be directly applied to closed-type cams because in the case of closed-type cams, the shock wave generated by the cam acting on the butt is not as strong as in the case of open-type cams, therefore there are fewer instances of broken needle heads. In practice, however, it is definitely possible to use the needle of the present invention for closed-type cams.

Because the positions of the working needle hook, the connecting projection and indentation, and of the butt of the butt needle may vary from one latch needle to another, it is difficult to quantify the relative distances between them. Judging from the experimental results (FIGS. 7 and 8) described later, the differences of these positions seem to influence the effect of the invention only to a limited degree.

The working needle and the butt needle are simply fitted at the connecting projection and indentation, and placed in the cylinder groove of the knitting machine manually by a worker. It is preferable to fit the two needles leaving virtually no gap between the projection and the indentation. It is also preferable to provide a means for reinforcing the connection of the two so as to avoid an accident such as the two needles getting separated from each other after being placed in the groove while the knitting machine is working.

As an example of such a connection reinforcing means, an auxiliary connection may be established at a place other than the connecting projection and indentation. The auxiliary connection is most preferably established on the bridge that is the closest to the needle head, in particular on the bridge pier that is the closer to the needle head, but it could also be situated at any other appropriate place. The auxiliary connection may-consist of a fastening indentation on the working needle and a fastening projection on the butt needle, which are engaged with one another. As another connection reinforcement means, the connection may consist of parts having wedge-shaped or other non-linear-shaped longitudinal sections. Alternatively, adhesive may be used for temporary connection.

In use of the latch needle of the present invention, the shock generated when the cam hits the butt is blocked by the connecting projection and indentation, and not transmitted directly to the needle head, resulting in a reduced possibility of damaging the needle head.

BRIEF DESCRIPTION OF THE DRAWINGS

Some of the objects and advantages of the present invention having been stated, others will appear as the description proceeds when considered in conjunction with the accompanying drawings, in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
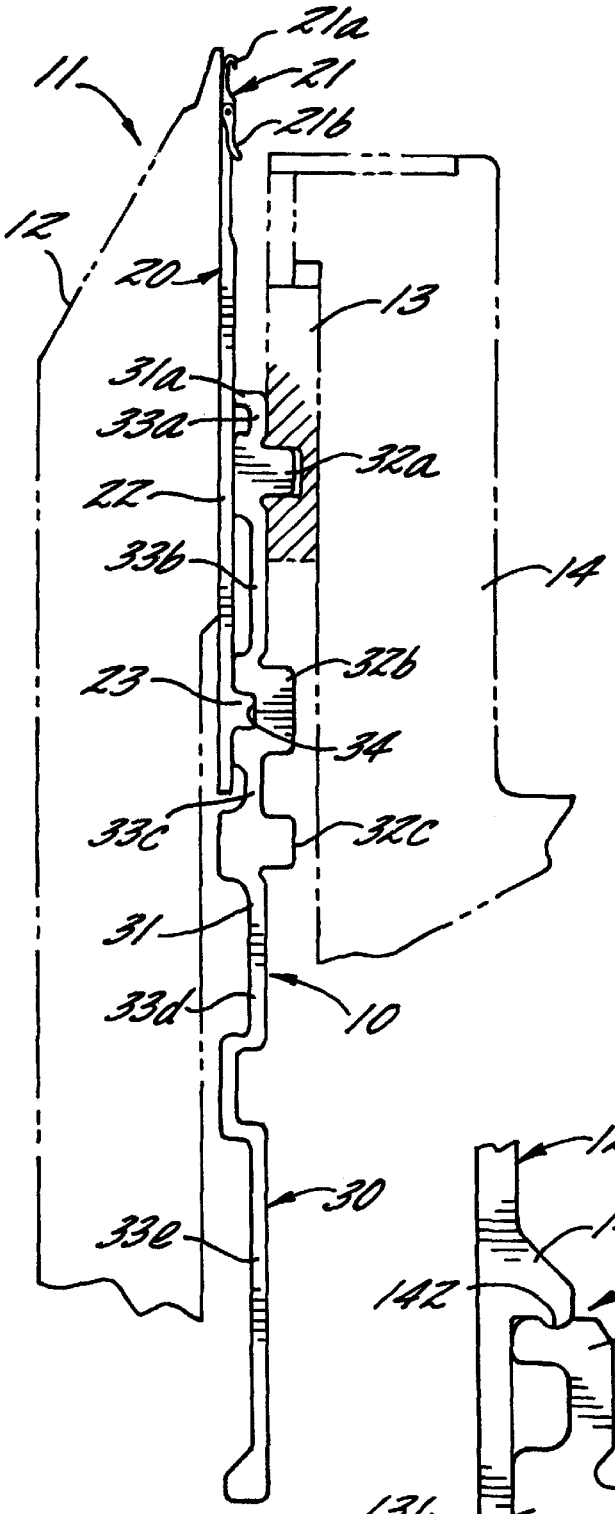
FIG. 1 is an elevational view of a latch needle of the present invention.

Referring now more specifically to the drawings and particularly to FIG. 1, there is illustrated a latch needle, generally indicated at 10, which incorporates the features of the present invention. Latch needle 10 includes a working needle, generally indicated at 20, and a butt needle, generally indicated at 30, connected together and mounted in a circular knitting machine, generally indicated at 11.

Circular knitting machine 11 includes a rotatable cylinder 12 having vertical grooves in which latch needles 10 are slidably mounted. Needle operating cams 13, only one of which is shown, are mounted on a cam block 14 and reciprocate the needles 10 as the cylinder 12 rotates.

Working needle 20 has a needle head 21 which includes a hook 21*a* and a pivotally mounted latch 21*b*. Working needle 20 also includes a body portion 22 extending downwardly from the needle head 21 to the opposite end of the working needle 20. The length of the working needle 20 may vary from about one-third to about the entire length of latch needle 10.

Connecting means 23 is carried by body portion 22 on the side thereof toward which the hook 21*a* faces and which faces the cam block 14 and preferably comprises at least one projection 23 which extends outwardly for a predetermined distance. The shape of the projection 23 is preferably rectangular, although other geometric shapes may be used.

Butt needle 30 includes a body portion 31 which extends the full length of butt needle 30. Body portion 31 has at least one butt 32*a* thereon adjacent the upper end 31*a* of the body portion 31. Frequently, butt needle 30 will have a plurality of butts thereon and as illustrated in FIG. 1, body portion 31 has three butts 32*a*, 32*b* and 32*c* thereon.

Body portion 31 preferably has cutouts in its opposite sides resulting in a so-called meander configuration and, as illustrated, has five bridges 33*a*, 33*b*, 33*c*, 33*d* and 33*e* thereon. Body portion 31 also has a connecting indentation 34 which receives the connecting projection 23 on working needle 20 to connect the working needle 20 and butt needle 30 together. While it is illustrated that the connecting projection 23 is on the working needle 20 and the connecting indentation is in the butt needle 30, it should be understood that the projection could be on the butt needle 30 and the indentation could be in the working needle 20.

The position of the connecting projection 23 and connecting indentation 34 is farther from the needle head 21 than the position of the butt 32*a*. Generally, the butt closest to the needle head is the butt that engages the needle lowering cam in an open cam track and generates the greatest shock wave. Therefore, in butt needles having more than one butt, it is the butt closest to the needle head that is of most concern and the one to which the present invention is particularly directed.

Figure 2:
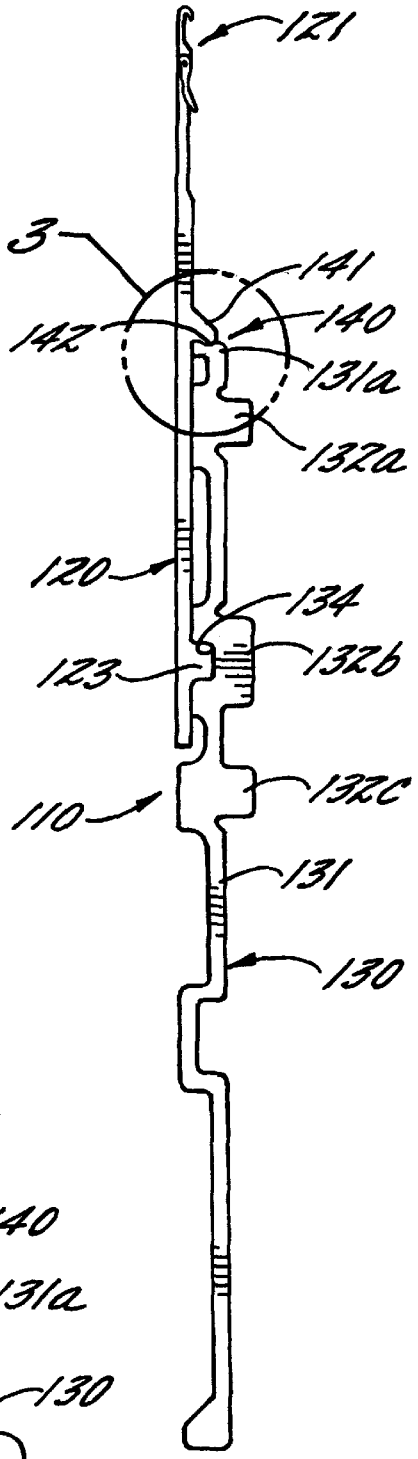
FIG. 2 is an elevational view of another embodiment of the latch needle of present invention.
Figure 3:
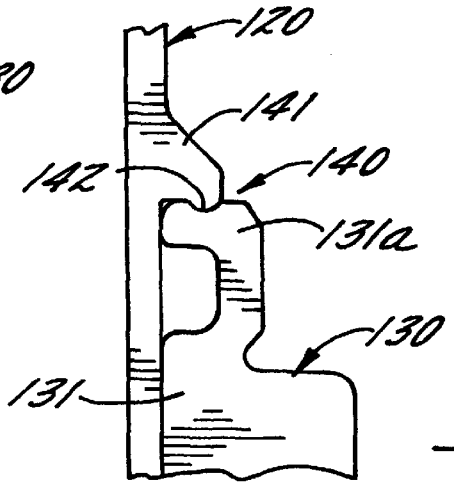
FIG. 3 is an enlarged, fragmentary detail view of the portion of the latch needle contained within the circle 3 in FIG. 2.

Referring now to FIGS. 2 and 3, there is illustrated another embodiment of the present invention in which like parts are referred to by like reference characters with a prefix "1" added thereto. Latch needle 110 includes a working needle 120 and a butt needle 130 which are connected by a connecting projection 123 and indentation 134. Butt needle 130 includes butts 132*a*, 132*b* and 132*c*.

Latch needle 110 differs from latch needle 10 in that it includes an auxiliary connecting means 140. As illustrated, auxiliary connecting means 140 includes a fastening projection 141 on the working needle 120 and a fastening indentation 142 in the upper end 131*a* of the body portion 131 of butt needle 130. When the fastening projection 141 is received in the fastening indentation 142, the connection of working needle 120 and butt needle 130 together is reinforced.

Figure 4:
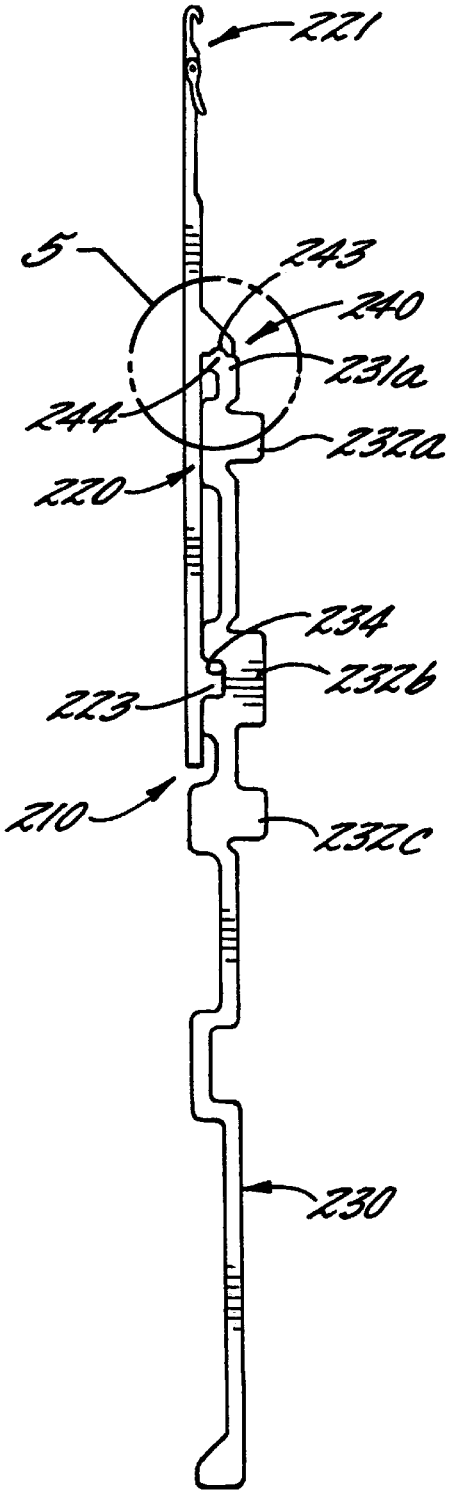
FIG. 4 is an elevational view of a further embodiment of the latch needle of the present invention.
Figure 5:
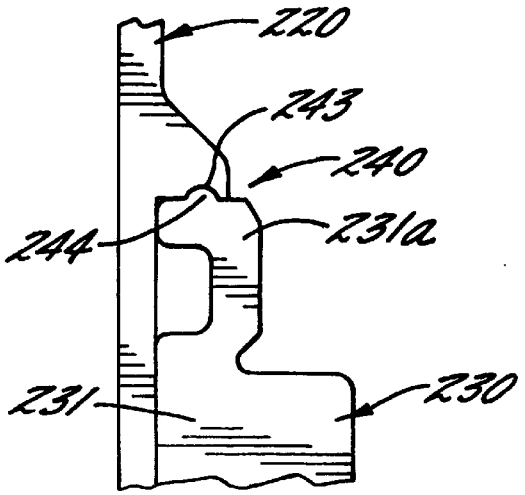
FIG. 5 is an enlarged, fragmentary detail view of the portion of the latch needle within the circle 5 in FIG. 4.

Referring to FIGS. 4 and 5, there is illustrated a further embodiment of the present invention in which like features are referred to by like reference characters with the prefix "2" added. Latch needle 210 is very similar to latch needle 110 except for auxiliary connecting means 240.

Latch needle 210 includes a working needle 220 having a needle head 221 and a connecting projection 223, and a butt needle 230 having butts 232*a*, 232*b* and 232*c* and a connecting indentation 234. Auxiliary connecting means 240 includes a fastening indentation 243 on working needle 220 and a fastening projection 244 on the upper end 231*a* of butt needle 230.

Figure 6:
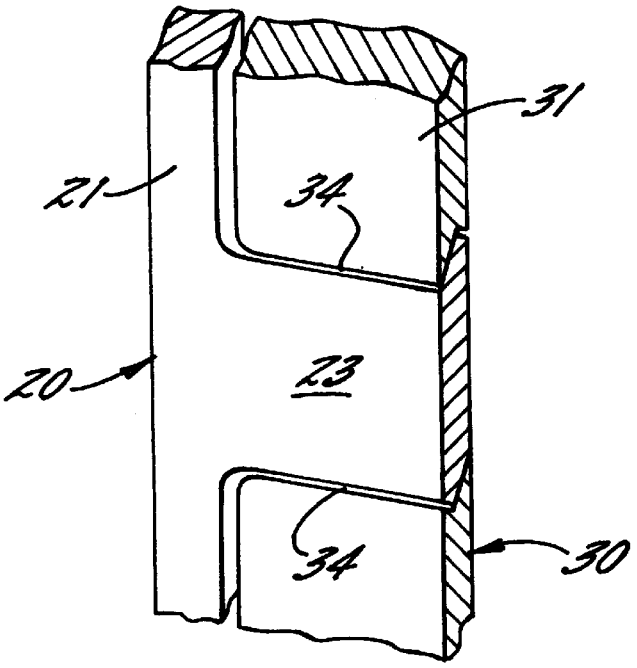
FIG. 6 is an enlarged, fragmentary detail view, partially in section, of the connecting means between the working needle and the butt needle of the latch needle of the present invention.
Figure 7A:
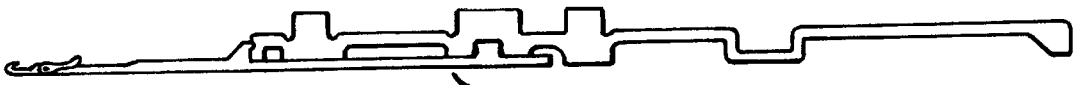
FIGS. 7A–7D are elevational views of latch needles of the present invention that were used in the experiment in which the present invention and the prior art were compared.
Figure 7B:
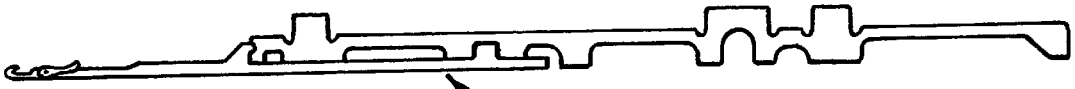
Figure 7C:
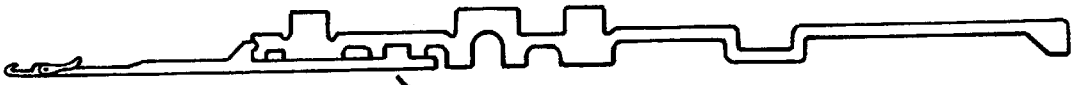
Figure 7D:
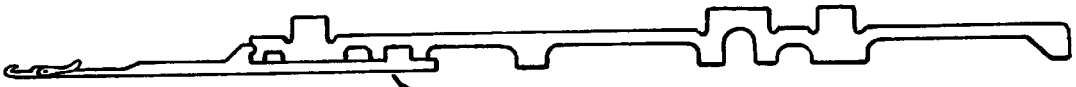
Figure 8A:
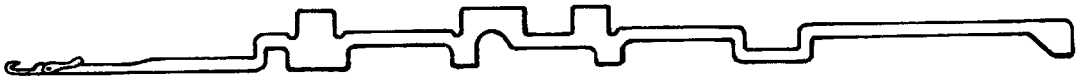
Fig. 8A. (PRIOR ART)
FIGS. 8A–8D are elevational views of prior art latch needles used in the experiment comparing the latch needles of the present invention to latch needles of the prior art.
Figure 8B:
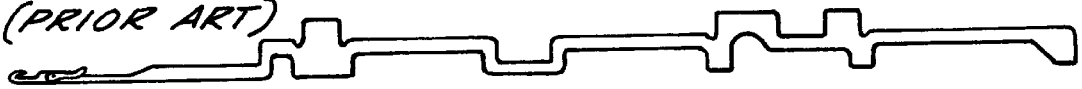
Fig. 8B. (PRIOR ART)
Figure 8C:
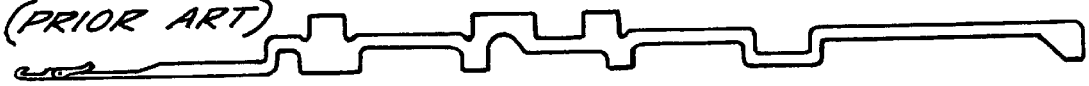
Fig. 8C. (PRIOR ART)
Figure 8D:
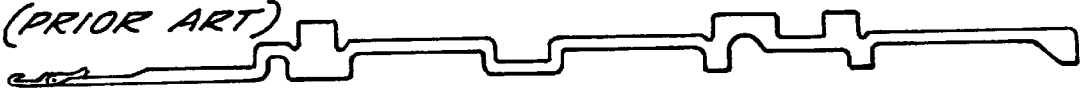
Fig. 8D. (PRIOR ART)

Referring now to FIG. 6, there is illustrated an enlarged detail of the connecting means including projection 23 on body portion 21 of working needle 20 and indentation 34 in body portion 31 of butt needle 30. As is evident, projection 23 is wedge-shaped in section and indentation 34 is correspondingly shaped. While other configurations may be used, the wedge-shape is preferred.

FIG. 7 illustrates latch needles 110 of the present invention while FIG. 8 illustrate so-called meander-type needles from the prior art. These needles were used in an idling experiment to investigate the breaking rate of each type. A type V-LPJ3B 30-inch, 18-gauge circular knitting machine manufactured by Precision Fukahara Works, Ltd. was used to perform the experiment and one hundred (100) needles of each type were placed in the cylinder. The shape of the cam used was as is disclosed in Japanese Patent Application No. A-8-49147 and the cams were set in a welt position at all yarn feeders with the stitch cams set to pull 1.75 mm. Until the total revolution count reached 100,000, the knitting machine was run at 35 rpm.

The results of the experiment are set forth in Table 1 below:

TABLE 1

(Numerical unit in the first line is thousand; "5" means five thousand, for instance)

| | 5 | 10 | 15 | 20 | 30 | 40 | 50 | 60 | 70 | 80 | 90 | 100 | Total | Breaking rate (%) |
|---|---|---|---|---|---|---|---|---|---|---|---|---|---|---|
| 7A | 0 | 0 | 0 | 0 | 0 | 0 | 0 | 0 | 0 | 0 | 0 | 0 | 0 | 0 |
| 7B | 0 | 0 | 0 | 0 | 0 | 0 | 0 | 0 | 0 | 0 | 0 | 0 | 0 | 0 |
| 7C | 0 | 0 | 0 | 0 | 0 | 0 | 0 | 0 | 0 | 0 | 0 | 0 | 0 | 0 |
| 7D | 0 | 0 | 0 | 0 | 0 | 0 | 0 | 0 | 0 | 0 | 0 | 0 | 0 | 0 |
| 8A | 2 | 12 | 21 | 11 | 9 | 6 | 2 | 2 | 2 | 0 | 0 | 1 | 78 | 78 |
| 8B | 4 | 14 | 19 | 12 | 8 | 9 | 4 | 0 | 0 | 2 | 4 | 3 | 79 | 79 |
| 8C | 3 | 22 | 13 | 14 | 5 | 2 | 0 | 3 | 0 | 3 | 3 | 0 | 68 | 68 |
| 8D | 0 | 4 | 10 | 10 | 5 | 5 | 3 | 1 | 1 | 3 | 4 | 2 | 48 | 48 |

It is evident from this table that breakages of the needle heads can be dramatically reduced using the present invention. The present invention is also accompanied by the following effects.

In the case of the conventional type of needle, when the needle head is broken, for example, even if the butt itself is not damaged, the whole needle has to be replaced. Conversely, if the butt is broken, even if the needle head is not damaged, the whole needle has to be replaced. Whereas in the case of the needle of the present invention, if the needle head is broken, only the working needle has to be replaced, and if the butt is broken, only the butt needle has to be replaced.

In the case of the conventional type of needle, because there are many different kinds of knitting machines, different kinds of latch needles with a variety of needle shaft dimensions, shapes and butt positions have to be prepared even if their needle heads may have the same dimensions and shape. Whereas using the technique of the present invention, one type of working needle can be used in combinations with different types of butt needles, which are generally easier to make in different forms, according to the different types of needle-selecting mechanisms of the knitting machine to be used. In other words, the butt needle also functions as an adapter that interlinks the working needle and the knitting machine.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A latch needle for use in high speed circular knitting machines and characterized by substantially reduced hook damage from shock waves, said needle comprising a working needle including an elongate body portion, a hook at one end of said body portion, a latch pivotally mounted on said body portion adjacent said hook and in cooperative relationship therewith, and first connecting means carried by said body portion in spaced relation to said hook, and a butt needle including an elongate body portion, a butt carried by said body portion adjacent one end of said body portion and adopted to engage an operating cam for reciprocating said needle, and second connecting means carried by said body portion in spaced relation to said butt and cooperating with said first connecting means on said working needle for connecting said working needle and said butt needle together such that said butt on said butt needle is located between said hook on said working needle and said first and second connecting means.

2. A latch needle according to claim 1 wherein said first and second connecting means comprise an indentation in said body portion of one of said working and butt needles and a projection carried by said body portion of the other of said working and butt needles and being received in said indentation.

3. A latch needle according to claim 2 wherein said projection is carried by said working needle and said indentation is in said butt needle.

4. A latch needle according to claim 1 including reinforcement means for reinforcing the connection of said working needle and said butt needle together by said connecting means.

5. A latch needle according to claim 4 wherein said reinforcement means comprises a fastening projection on one of said working needle and said butt needle and a fastening indentation in the other of said working needle and said butt needle.

6. A latch needle according to claim 5 wherein said fastening projection is on said working needle and said fastening indentation is in said butt needle.

7. A latch needle according to claim 5 wherein said fastening projection is on said butt needle and said fastening indentation is in said working needle.

8. A latch needle according to claim 5 wherein said reinforcement means is position between said hook on said working needle and said butt on said butt needle.

9. A latch needle according to claim 2 wherein said connecting projection is wedge-shaped in cross-section and said connecting indentation is conformingly shaped.

* * * * *

UNITED STATES PATENT AND TRADEMARK OFFICE
CERTIFICATE OF CORRECTION

PATENT NO. : 5,941,099

DATED : August 24, 1999

INVENTOR(S) : Kawase

It is certified that error appears in the above-identified patent and that said Letters Patent is hereby corrected as shown below:

On the title page, after the Application No. and Filing Date, insert:

--Foreign Application Priority Data

October 8, 1997 Japan 9-293236--.

Column 5, Table 1, third column, line 5, "12" should read --22--.

Signed and Sealed this

Seventh Day of March, 2000

*Attest:*

*Attesting Officer*

Q. TODD DICKINSON

*Commissioner of Patents and Trademarks*